US005558607A

United States Patent [19]

Darling

[11] Patent Number: 5,558,607

[45] Date of Patent: Sep. 24, 1996

[54] TRAINING DEVICE FOR MARTIAL ART ATHLETES

[76] Inventor: Thomas G. Darling, 727 N. 300 E, Decatur, Ind. 46733

[21] Appl. No.: 527,195

[22] Filed: Sep. 12, 1995

[51] Int. Cl.[6] ..... A63H 1/02

[52] U.S. Cl. ..... 482/95; 482/907

[58] Field of Search ..... 482/907, 95, 98, 482/69, 99, 101, 102, 143; 294/1.1

[56] References Cited

U.S. PATENT DOCUMENTS

| | | | |
|---|---|---|---|
| 325,404 | 9/1885 | Forest | 482/102 |
| 3,658,327 | 4/1972 | Thiede | 482/96 |
| 4,619,453 | 10/1986 | Plumridge | 482/102 |
| 4,844,453 | 7/1989 | Hestilow . | |
| 4,974,837 | 12/1990 | Someya et al. | 482/98 |
| 5,026,049 | 6/1991 | Goodman . | |
| 5,480,375 | 1/1996 | La Fosse et al. | 482/95 |

FOREIGN PATENT DOCUMENTS

| | | | |
|---|---|---|---|
| 2403089 | 4/1979 | France | 482/95 |

OTHER PUBLICATIONS

Inside Tae Kwon Do (Advertisment), Jun. 1993, p. 19.

FlexMaster III™ (Advertisment) (Patent #4844453) Inside Tae Kwon Do, Jun. 1993, p. 39.

FlexMaster IV, Advertisment, source unknown.

Stretchrite (The Ultimate Leg Stretching Machine) Advertisement Source unknown (Patent #5026049).

*Primary Examiner*—Jerome Donnelly

*Attorney, Agent, or Firm*—Todd A. Dawson

[57] ABSTRACT

The training device of this invention allows the athlete to stretch his leg and back muscles in the same general position as used to perform the various styles of kicks. The training device includes a generally rectangular frame which is mounted vertically on a wall. A foot pad is slidably carried by the frame and is connected to a cable and pulley system to shift the pad along the frame. In use, the athlete places one foot on the pad while balancing on the other foot. The athlete then pulls handles connected to the cable to raise the pad until the proper amount of stretching is achieved. A pair of handles are connected along the length of the cable which allows the athlete to raise the pad to a higher level by pulling on the second handle. Therefore, using the training device of the subject invention, the athlete's muscles are stretched in an active position simulating more closely the position of the muscles during an actual kick. The foot pad defines a recess which accommodates a portion of the athlete's heel during a front kick stretching maneuver or a portion of his instep or toes during a side kick stretching maneuver.

2 Claims, 4 Drawing Sheets

TRAINING DEVICE FOR MARTIAL ART ATHLETES

SUMMARY OF THE INVENTION

This invention relates to training devices for individuals involved in the martial arts and has specific relevance to a muscle stretching device.

BACKGROUND OF THE INVENTION

Many of the martial arts require the athlete to extend one of his legs in a kicking action. One of the goals of the athlete is to kick as high as possible while maintaining his balance. To assist the athlete in the performance of these kicks, a number of devices have been developed to stretch the legs muscles for the athlete. Stretching the leg muscles of the athlete increases his flexibility and thereby allows the athlete to extend his body to its maximum potential during a kick maneuver.

A problem exists however in the current state of the art stretching devices. The prior art stretching devices are passive. In other words, the athlete sits on the floor or on the stretching device to stretch his legs. The sitting position for use of these devices in no way actively simulates the actual kicking stance and requires the athlete to take a rather passive role in the stretching process. Further, while the athlete may perform a variety of kicks, i.e. front kicks, side kicks and back kicks, the passive stretching devices of the prior art only allow the athlete to stretch his muscles in a single position.

SUMMARY OF THE INVENTION

The training device of this invention eliminates the problem discussed above by providing a stretching device which allows the athlete to stretch his leg and back muscles in the same general position as used to perform the various styles of kicks. The training device includes a generally rectangular frame which is mounted vertically on a wall. A foot pad is slidably carried by the frame and is connected to a cable and pulley system to shift the pad along the frame. In use, the athlete places one foot on the pad while balancing on the other foot. The athlete then pulls handles connected to the cable to raise the pad until the proper amount of stretching is achieved. A pair of handles are connected along the length of the cable which allows the athlete to raise the pad to a higher level by pulling on the second handle. Therefore, using the training device of the subject invention, the athlete's muscles are stretched in an active position simulating more closely the position of the muscles during an actual kick. The foot pad defines a recess which accommodates a portion of the athlete's heel during a front kick stretching maneuver or a portion of his instep or toes during a side: kick stretching maneuver.

Accordingly, it is an object of the invention to provide for a novel training device.

Another object of the invention is to provide for a muscle stretching device for martial arts athletes.

Yet another object of the invention is to provide for a novel stretching device for martial arts athletes that permits the athlete to stretch the muscles in a kicking position.

Still other objects of the invention will become apparent upon a reading of the following description taken with the accompanying drawings.

DESCRIPTION OF THE PREFERRED EMBODIMENT

The preferred embodiment herein described is not intended to be exhaustive or to limit the invention to the precise form disclosed. Rather, it is chosen and described in order to fully explain the invention to those skilled in the art.

Figure 1:
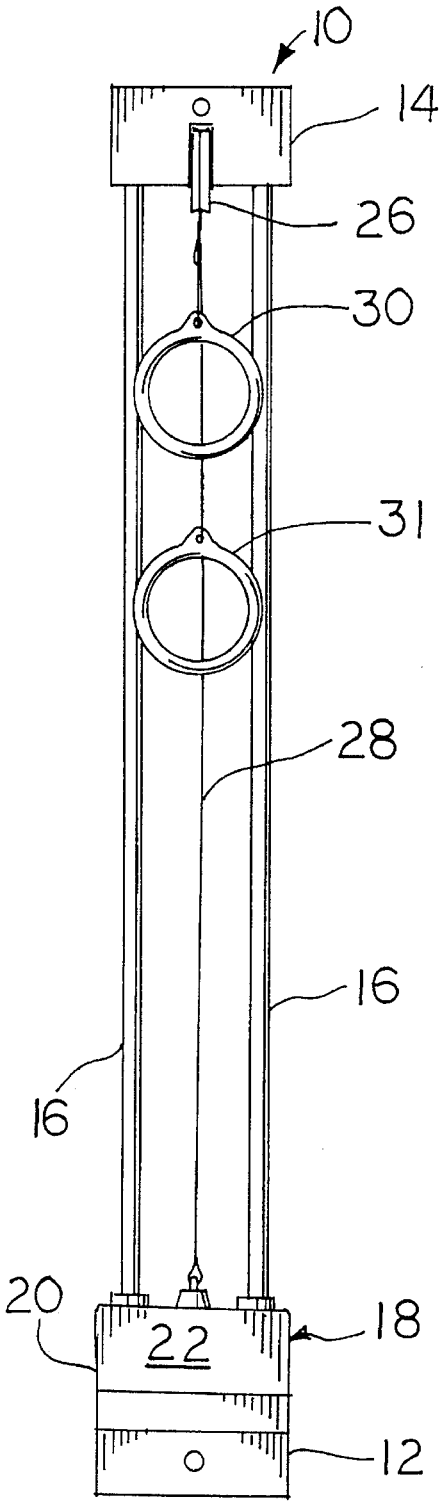
FIG. 1 is a front elevational view of the training device of the invention.
Figure 2:
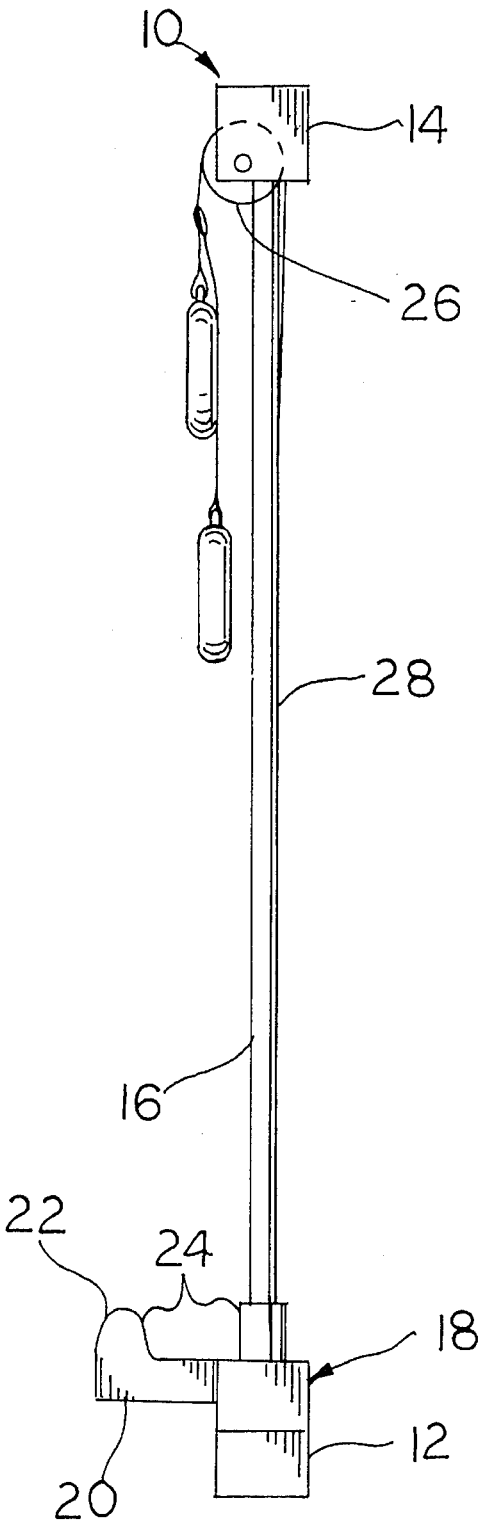
FIG. 2 is a side elevational view of the training device of the invention.

As illustrated in the figures, training device 10 is generally rectangular in shape and includes a base 12 and a top 14 interconnected by a pair of tubular rails 16. Rails 16 are parallel to one another and are rigidly connected to the base by a suitable connection means such as a screw (not shown). A lift 18 is slidably carried by rails 16 and is shiftable along the rails between base 12 and top 14. A pad 20 which extends generally horizontally outward and generally perpendicular from the lift 18 and includes a cushioned support 22 which extends generally transverse to and upwardly from the pad as illustrated in FIG. 2. As illustrated, support 22 is spaced from lift 18 to define a recess 24 therebetween. A pulley 26 is rotationally carried by top 14 so as to freely rotate about the axis of the pulley. A cable 28 is connected at one end to lift 18 and at its other end to a pair of rings 30, 31. As illustrated, rings 30, 31 are spaced apart from one another along the length of the cable 28. As handles 30, 31 are pulled away from top 14, lift 18 is pulled along rails 16 toward top 14. As the handles are released or allowed to be drawn toward top 14, lift 18 slides along the rails in direction of base 12. Base 12 and top 14 are configured to accommodate screws or similar fastening devices therethrough to provide for the connection of the training device 10 to a wall or similar vertical support structure.

Figure 3:
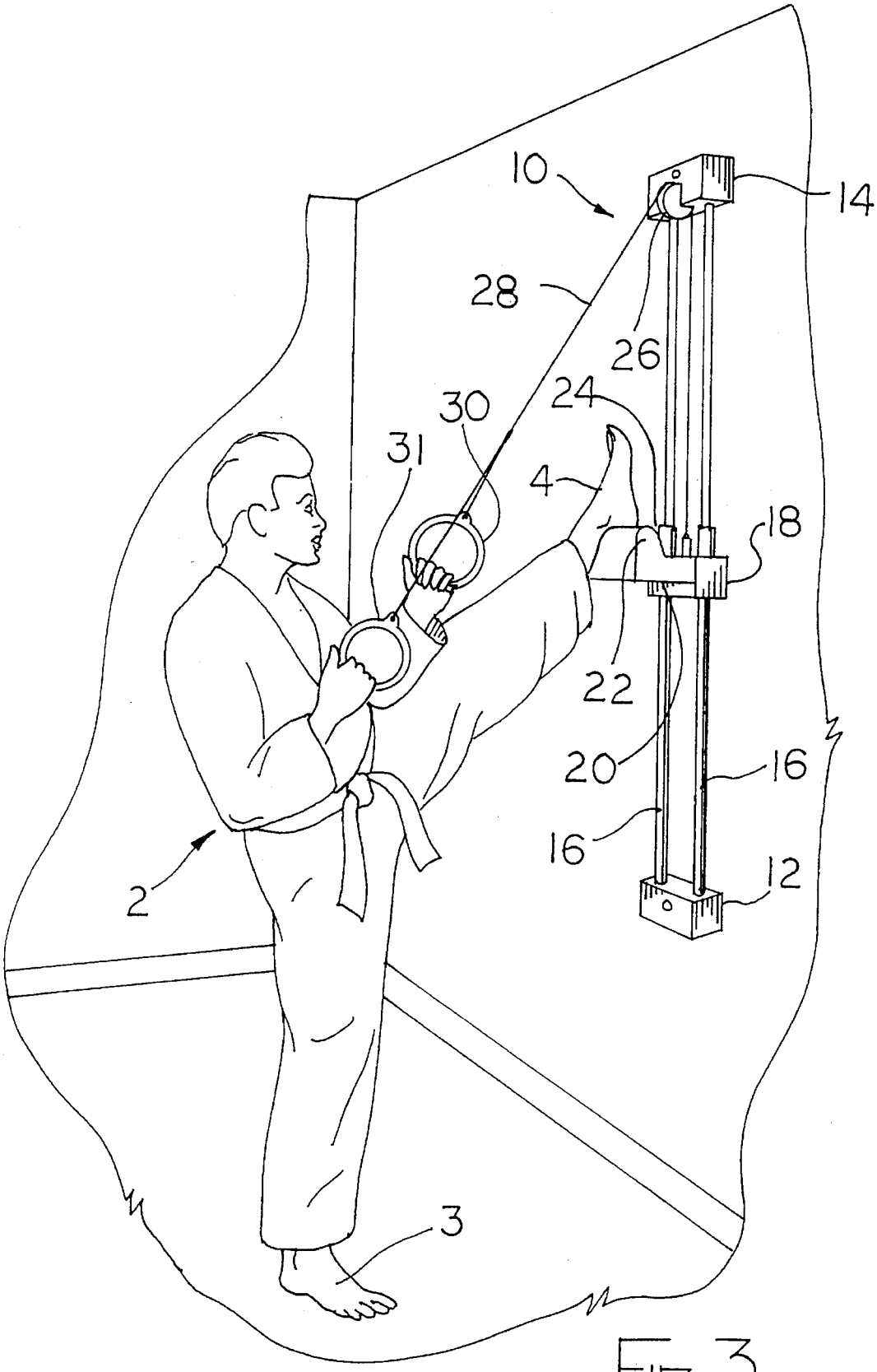
FIG. 3 is a perspective view of the training device of the invention in use in its environment with a martial arts athlete positioned in a front kick position.
Figure 4:
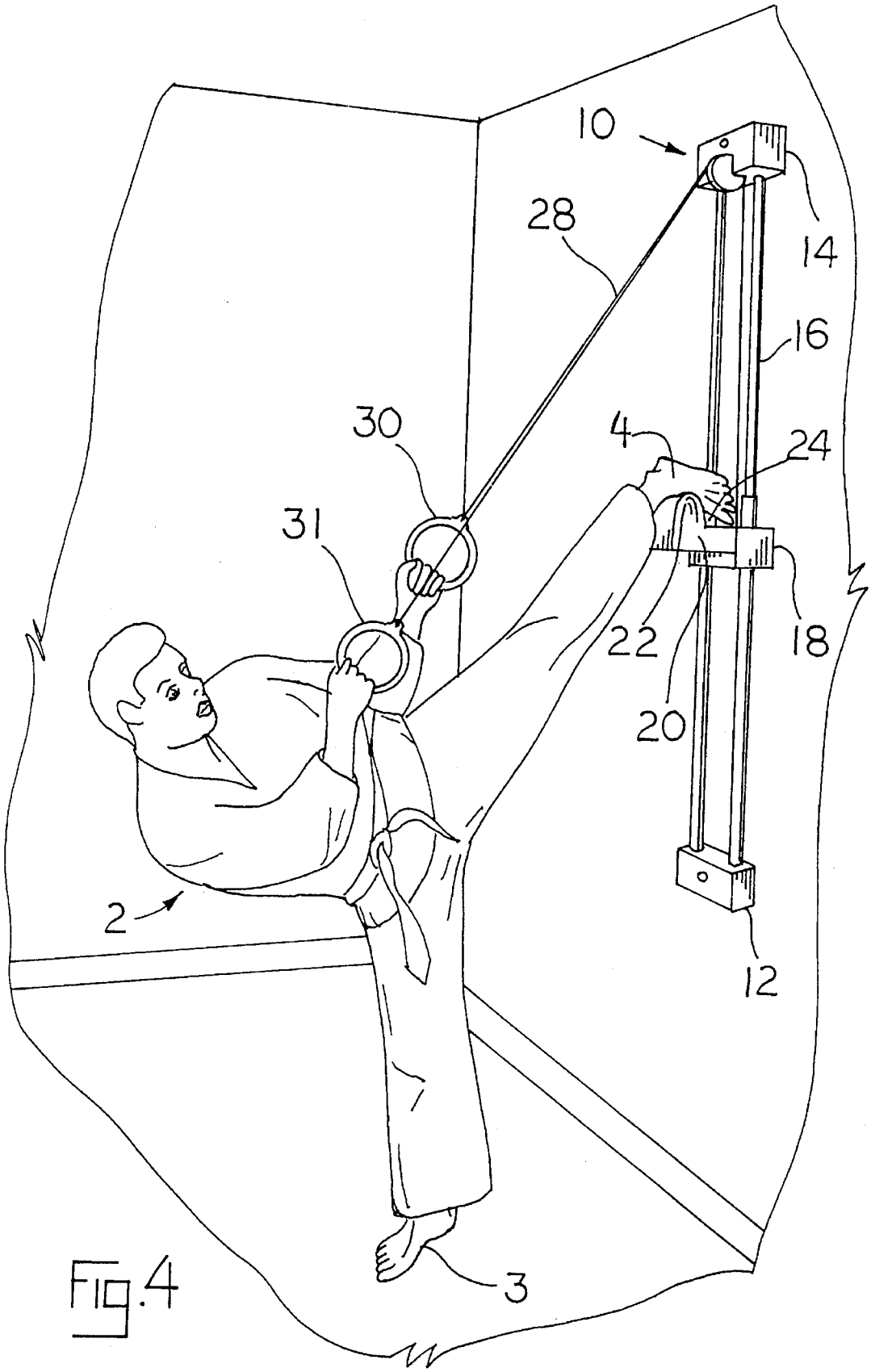
FIG. 4 is a perspective view of the training device of the invention in use in its environment with a martial arts athlete positioned in a side kick position.
Figure 5:
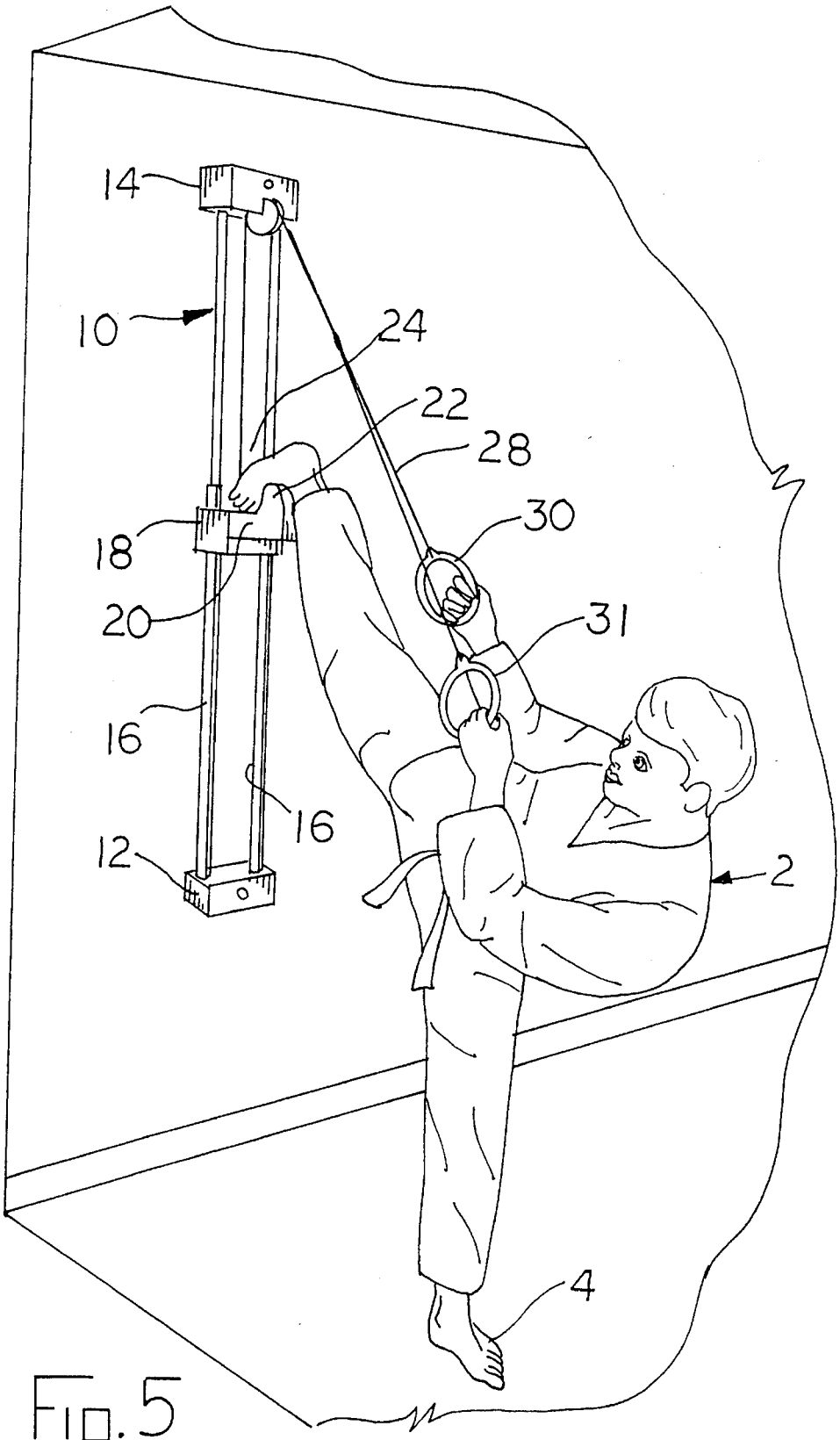
FIG. 5 is a perspective view of the training device of the invention in use in its environment with a martial arts athlete positioned in a back kick position.

FIGS. 3–5 illustrate the training device 10 of the invention in use. In FIG. 3, the athlete 2 is positioned in what would be considered a general front kick position with a foot 3 on the floor and a foot 4 hooked over support 22 so that the heel portion of foot 4 is generally positioned within recess 24. Note that as the athlete pulls on handles 30, 31, lift 18 shifts along rails 16 and closer to top 14. It should also be noted that the athlete is holding each handle. However, if he requires additional stretching force, both hands could grasp handle 30, thereby allowing the athlete to raise lift 18 a greater distance. In FIG. 4, the athlete 2 is positioned in a general side kick position with foot 3 on the floor and foot 4 hooked over support 22 such that a portion of the instep and toes of foot 4 are positioned within recess 24. Again, as handles 30, 31 are pulled by the athlete, the lift 18 rises to stretch the leg muscles of the athlete. Finally, in FIG. 5, the athlete 2 is positioned in a general back kick position with foot 4 on the floor and foot 3 hooked over support 22 and extending into the recess 24.

It should be understood that the invention is not to be limited to the precise forms disclosed but may be modified within the keeping of the appended claims.

I claim:

1. A training device for the athletes, the device including a generally rectangular frame member having a base and top interconnected by a pair of rails, the frame being configured for connection to a vertical support structure, a lift carried on the pair of rails and shiftable along the rails between the top and bottom of the frame, the lift having a pad attached thereto, said pad extending generally horizontally outward and substantially perpendicular, from the lift, said pad including a support which extends generally transverse to and upwardly from the pad, said pad and lift defining a recessed area between the support and the rails, said recessed area being configured in size to accommodate an athlete's foot, a pulley being carried by the top, a cable extending over the pulley and being connected at a first end to the lift and at a second end to a handle.

2. The training device of claim 1 and including a second handle connected to the second end of the cable and spaced from the first mentioned handle.

* * * * *